US005447144A

United States Patent [19]

Ivy

[11] Patent Number: 5,447,144

[45] Date of Patent: Sep. 5, 1995

[54] APPARATUS FOR THROWING FOOTBALLS

[76] Inventor: Jessie T. Ivy, 686 W. Shore Dr., Anacortes, Wash. 98221

[21] Appl. No.: 974,784

[22] Filed: Nov. 12, 1992

[51] Int. Cl.[6] ..... F41B 7/00; A63B 65/12; A63B 69/40

[52] U.S. Cl. ..... 124/26; 124/21; 124/27; 124/81

[58] Field of Search ..... 124/16, 17, 21, 26, 124/27, 29, 81

[56] References Cited

U.S. PATENT DOCUMENTS

| | | | |
|---|---|---|---|
| 2,781,753 | 2/1957 | Formis | 124/16 |
| 2,921,574 | 1/1960 | Saito | 124/17 X |
| 3,570,467 | 3/1971 | Belokin | 124/26 |
| 3,589,059 | 6/1971 | Caswell | 124/16 X |
| 3,926,170 | 12/1975 | Dixon | 124/8 |
| 3,951,125 | 4/1976 | Dixon | 124/8 |
| 4,086,901 | 5/1978 | Clement | 124/21 |
| 4,164,928 | 8/1979 | Meares | 124/16 |
| 4,165,729 | 8/1979 | Niemirow | 124/17 |
| 4,261,319 | 4/1981 | Dixon | 124/21 |
| 5,224,701 | 7/1993 | Sciarrillo | 124/81 X |

*Primary Examiner*—Eric K. Nicholson
*Assistant Examiner*—John Ricci
*Attorney, Agent, or Firm*—Hughes, Multer and Schacht

[57] ABSTRACT

Apparatus for propelling projectiles and particularly suited to throwing footballs. The apparatus includes (a) a structural frame having elongate bearing surfaces and a forward end from which the projectiles are ejected; (b) a ball carriage adapted to contain the projectile, the carriage being slidingly mounted on the bearing surfaces; (c) at least one resilient member for so urging the carriage along the bearing surfaces towards the forward end that the projectile is propelled from the carriage at the forward end of the frame; and (d) a ball rotating assembly mounted on the ball carriage for applying rotation to the projectile as the projectile is propelled from the apparatus. A locking apparatus may also be provided for releasably locking the ball carriage relative to the structural frame. The propelling apparatus, when used in conjunction with a supporting pole, can be accurately aimed and operated by one person.

23 Claims, 10 Drawing Sheets

20
7
7
6
6
114
94
102
104
104
106
102
106
32
100
40
32
100
40
34
24
44
50
50
44
30
52
52
64
96
108
80
110
112
116
92
36
56
38
98

30
32
34
24
32
40
44
50
42
46a
48
96
62
70
68e
62a
36
52
68d
3B
3B
68b
60
68c
9
9
46
46b
52
46b
68a
3A
76
3A
66c
54
58
64
92
66b
82c
82b
82a
84
86b
82
80
80a
56
64a
76
56
66
66a
86a
38
78
A
98
90
64
64b
54
68e
70

APPARATUS FOR THROWING FOOTBALLS

TECHNICAL FIELD OF THE INVENTION

The present invention relates to methods and apparatus for throwing balls and, more particularly, to novel, improved methods and apparatus for throwing footballs and baseballs in a manner that simulates the throw of an individual.

BACKGROUND OF THE INVENTION

The present invention is particularly suited for use in propelling footballs, and that use will be discussed in detail herein; however, the basic concepts of this invention may have broader application. Accordingly, the scope of the invention is to be determined by the claims appended hereto and not the following detailed discussion.

A football team typically includes from three to five quarterbacks, and usually only one of these quarterbacks (the starting quarterback) is primarily relied on during game situations. On the other hand, a typical team will include ten or more players, i.e., running backs, tight ends, split ends, etc, who are responsible for catching passes and who will see substantial amounts of game playing time. However, due to physical limitations, it is usually not possible for the starting quarterback to practice with all of the players responsible for catching passes during game situations.

Therefore, during practice situations, it is common to employ back-up quarterbacks and others to throw passes to the players responsible for catching passes during the game. The problem with this approach is that each individual throws passes in a slightly different manner. An extreme example would be the situation in which the starting quarterback is left-handed; a left-handed quarterback will impart a spin to the ball opposite to that of right-handed quarterback. Thus, if the back-up quarterback is right-handed and employed during practice situations, the spin, tendency to drift, and other characteristics of the ball in flight will be different during practice situations than during game situations. The players catching the ball thus will often not get sufficient practice with the ball as it will be thrown during game situation.

While the situation is most extreme with left and right-handed quarterbacks, the flight characteristics of balls thrown by quarterbacks with the same dominant arm can also differ: one quarterback may throw hard and direct with tight spin, while another may loft the ball more with a looser spin.

It is also highly desirable that a football throwing apparatus be operable by one person.

Accordingly, apparatus and methods are needed for simulating the throwing characteristics of a specific individual to allow a football team to practice under conditions that are similar to game conditions.

A number of devices have been proposed to throw a football. U.S. Pat. Nos. 3,926,170 and 3,951,125 issued to Dixon disclose catapult devices that are designed to throw a football in a manner that simulates the arm motion of a human passer. These devices do not provide the flexibility required to simulate the throw of a specific individual and thus do not solve the problems discussed above.

U.S. Pat. No. 4,261,319 to Dixon discloses a devices that slings a football while imparting spin thereto. This patent requires a modified football and also cannot be tuned to approximate the throwing motion of a specific individual.

U.S. Pat. No. 4,086,901 to Clement and U.S. Pat. No. 4,165,729 to Niemirow disclose devices for propelling projectiles. Neither of these patents are designed to throw footballs and thus are not designed to impart spin to the projectiles propelled thereby. Further, these devices in no way could be tuned to approximate the throwing style of a particular individual.

There thus remains a need for apparatus and methods of throwing footballs which approximate the throwing style of a particular individual.

OBJECTS OF THE INVENTION

From the foregoing, it should be clear that an important object of the present invention is to provide improved football throwing apparatus and methods.

Another more specific object is to provide a football throwing apparatus having a favorable combination of the following characteristics:

a. accurately simulating the throwing characteristics of a particular individual;
b. consistent and accurate throwing of footballs;
c. operable by one person; and
d. adjustable to allow the simulation of the throwing characteristics of more than one individual.

SUMMARY OF THE INVENTION

It has now been found that these and other objects may be achieved with a device for throwing footballs having a ball carriage slidingly supported by guide rails. The carriage contains components that grip the ball. The carriage also houses a ball rotating assembly designed to impart spin to the ball. The carriage is so connected to one end of the guide rails by elastic members that the carriage may be moved in a first, locked position in which the elastic members are stretched. As the carriage is released from its locked position, the elastic members cause the carriage to move violently into a second position, propelling the ball forward. When the carriage is stopped in the second position, the ball rotating assembly imparts a spin to the ball as the ball is released by gripping members in the second position.

The amount and direction of spin imparted by the ball rotating assembly are adjustable to allow the flight characteristics of the ball to approximate those of a specific individual. This allows others unlimited practice at receiving passes having flight characteristics which are similar to those of a ball thrown by a specific, key individual.

An example of the advantageous that can be obtained by an apparatus such as the one just described is that it allows more than one football having given flight characteristics to be thrown at one time. This allows more than one receiver at a time in a practice play to have a pass thrown to them, multiplying the number of players who get meaningfull practice during each play.

Further objects, features, and advantages of the present invention will be apparent to the reader from the foregoing and the appended claims and as the ensuing detailed description and discussion proceeds in conjunction with the accompanying drawings.

DETAILED DESCRIPTION OF THE INVENTION

Figure 1:
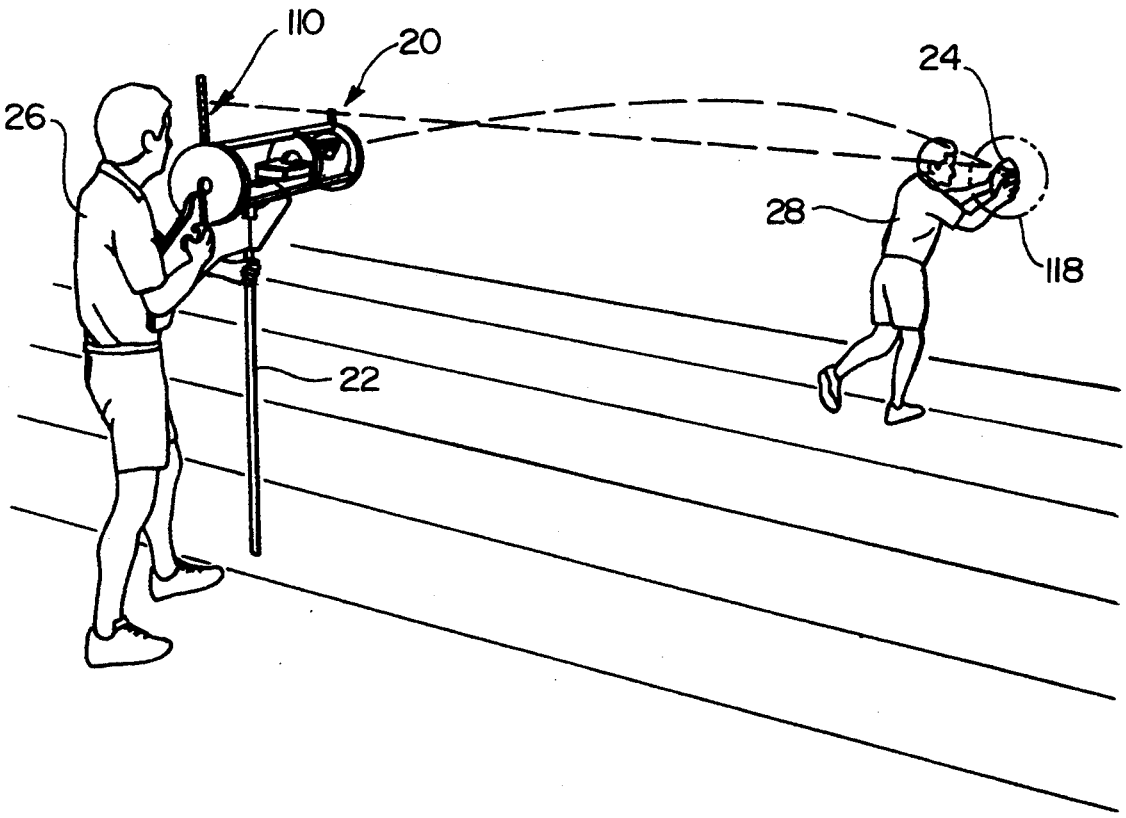
FIG. 1 is a perspective view depicting the use of a football throwing apparatus constructed in accordance with the principles of the present invention.

Referring now to the drawing, depicted at 20 in FIG. 1 is a football throwing apparatus embodying, and constructed in accordance with, the principles of the present invention. The apparatus 20 is mounted on a stand 22 and throws a football 24. An operator 26 operates the apparatus 20 and a pass catcher 28 catches the football 24 thrown by the apparatus 20.

Figure 2:
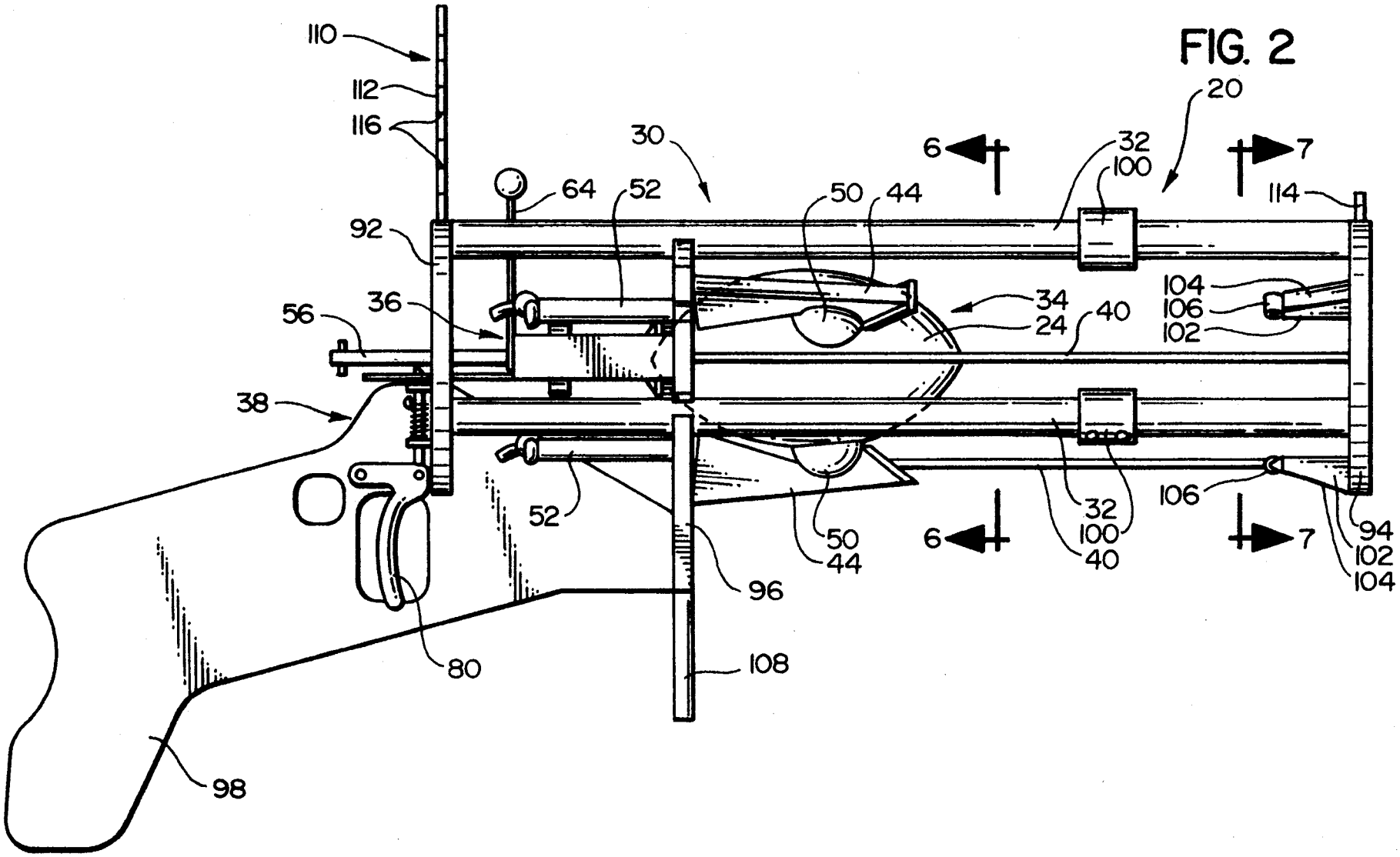
FIG. 2 is a side, plan view of the football throwing apparatus of FIG. 1.

The apparatus 20 is depicted in further detail in FIGS. 2–20. Referring initially to FIG. 2, it can be seen that the apparatus 20 basically comprises: (a) a structural frame 30 having rails 32; (b) a ball carriage 34 slidingly mounted on the rails 32; (c) a ball rotating assembly 36 fixedly mounted to the carriage 34; (d) a locking mechanism 38 for locking the carriage 34 in a locked position with respect to the structural frame 30; and (e) elastic members 40 connected between the carriage 34 and the frame 30.

The apparatus 20 operates in the following basic manner. Initially, the ball rotating assembly 36 is next wound in a first direction into a cocked state. The ball 24 is inserted into and gripped by the ball carriage 34. The ball carriage 34 is then drawn towards the locking mechanism 38 in a manner that stretches the elastic members 40. The locking mechanism 38 locks the ball carriage 34 into a loaded position. The locking mechanism 38 is then operated to release the ball carriage 34. The elastic members cause the ball carriage 34 to move out of the loaded position and slide along the rails 32 towards a second position. When the ball 24 reaches the second position, the ball carriage 34 releases the ball 24, at which point the ball rotating assembly 36 unwinds and imparts axial rotation or spin to the ball 24 as it leaves the apparatus 20.

The amount and direction of spin imparted to the ball 24 as it leaves the apparatus 20 is determined by the ball rotating assembly 36. The more this assembly 36 is wound into its cocked state, the greater the spin that is imparted to the ball 24 when it is released. Also, the direction in which the assembly 36 is rotated as it is wound into its cocked state determines the direction of the spin imparted to the ball 24. By appropriately adjusting both the magnitude and direction of spin, the throwing characteristics of a specific individual can be closely approximated by the apparatus 20.

In the following detailed discussion of the football throwing apparatus 20, a longitudinal axis is defined for the apparatus 20 by a line A in the drawing. The terms "inward, inner" and "outward, outer" will refer to directions radially towards and away from the longitudinal axis A, respectively. The terms "front, forward", "rear, backward", "top, upper", and "bottom, lower" will refer to those directions to the right, left, top, and bottom, respectively, in FIGS. 2–5, 8, and 10.

Figures 3, 3A, 3B:
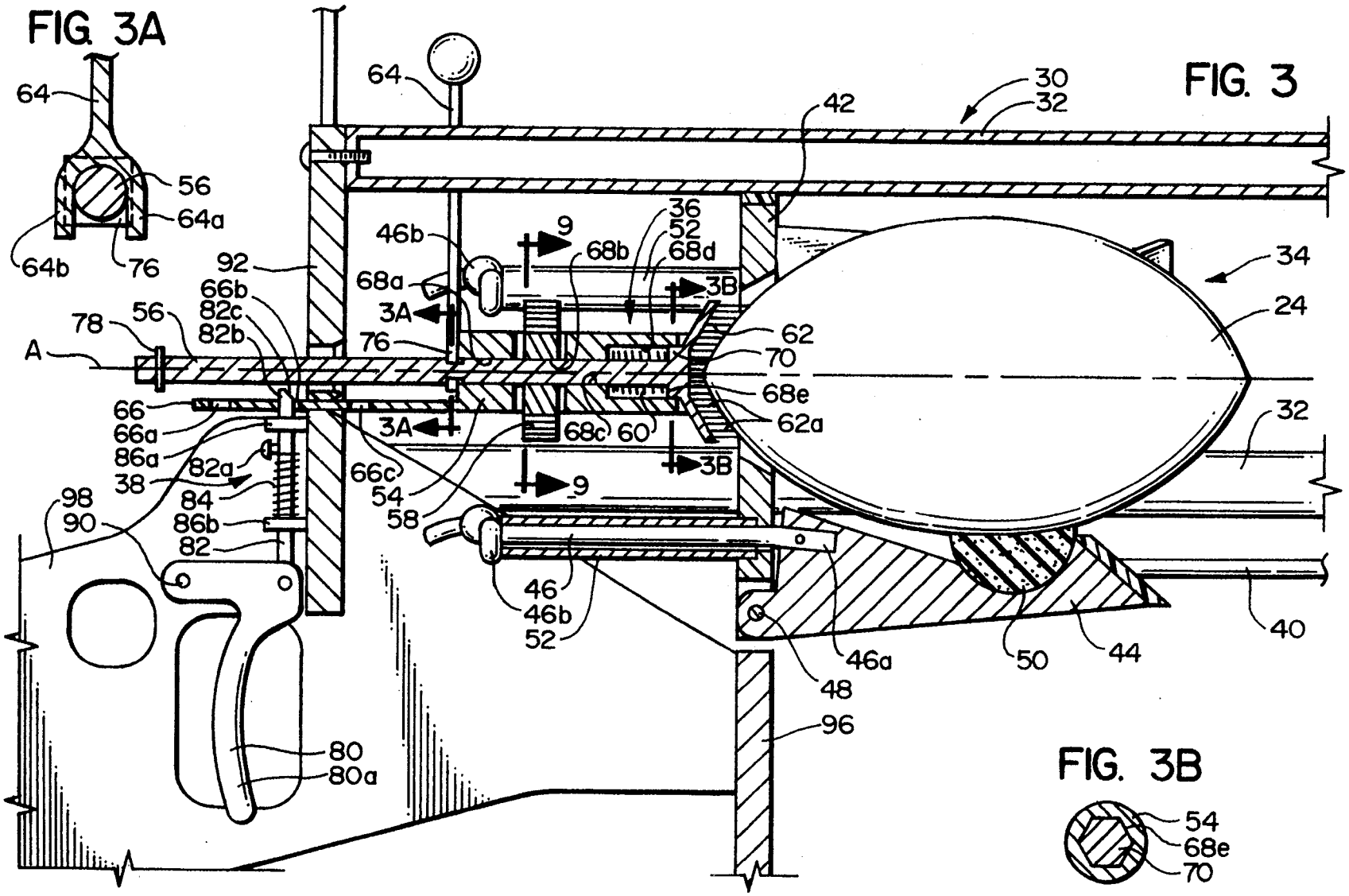
FIG. 3 is a side, cut-away view of a section of the apparatus depicted in FIG. 1.
FIG. 3A is taken along lines 3A—3A in FIG. 3.
FIG. 3B is taken along lines 3B—3B in FIG. 3.

Referring now to FIG. 3, the ball carriage 34, ball rotating assembly 36, and locking mechansim 38 will be described in further detail. The ball carriage 34 basically comprises a carriage plate 42, a plurality of gripping arms 44, and a tensioning member 46 for each of the gripping arms 44.

The carriage plate 42 is so slidingly mounted on the rails 32 that the plate 42 can move along the longitudinal axis A. The gripping arms 44 are rotatably mounted to the carriage plate 42 by hinges 48. These gripping arms 44 further comprise resilient gripping members 50 which engage the football 24 as will be described in further detail below.

The tensioning members 46 are each mounted within a tensioning member tube 52 that is fixed relative to the carriage plate 42. The tensioning members 46 are attached at first ends **46*a* to one of the gripping arms 44 and are fixed at second ends 46*b* to the tubes 52 and thus relative to the plate 42. The first ends 46*a* are so connected to the gripping arms 44 relative to the hinges 48 that the arms 44 are biased towards the longitudinal axis A. Accordingly, when the football 24 is arranged on the axis A between the arms 44, the tensioning members 46 force the gripping arms 44 to rotate inwardly, causing the gripping members 50 to engage and grip the football 24**.

The above-introduced ball rotating member 36 basically comprises a housing portion 54, a shaft 56, a torsion spring assembly 58, a compression spring 60, and a ball engaging member 62. A locking fork 64 is provided to engage the shaft 56 and prevent the shaft 56 from rotating or moving forward during loading of the football 24, as will be discussed in detail below. Also, a lock flange 66 extends rearwardly from the housing portion 54 to enable the locking mechanism 38 to engage the housing 54 and thus lock the housing 54 relative to the structural frame 30.

The housing portion 54 is fixed to the carriage plate 42. Accordingly, by locking the housing 54 relative to the frame 30 as just described, the ball carriage 34 is locked into the locked position relative to the frame 30. Additionally, as the carriage plate 42 moves along the rails 32, the housing 54 also moves along the longitudinal axis A.

The shaft 56 extends through an orifice 68 the housing 54 along the longitudinal axis A. The orifice 68 passes completely through the housing 54 along the axis A and comprises a rear portion 68*a*, a tortions spring portion 68*b*, a middle portion 68*c*, a compression spring portion 68*d*, and a hex portion 68*e*.

Figure 9:
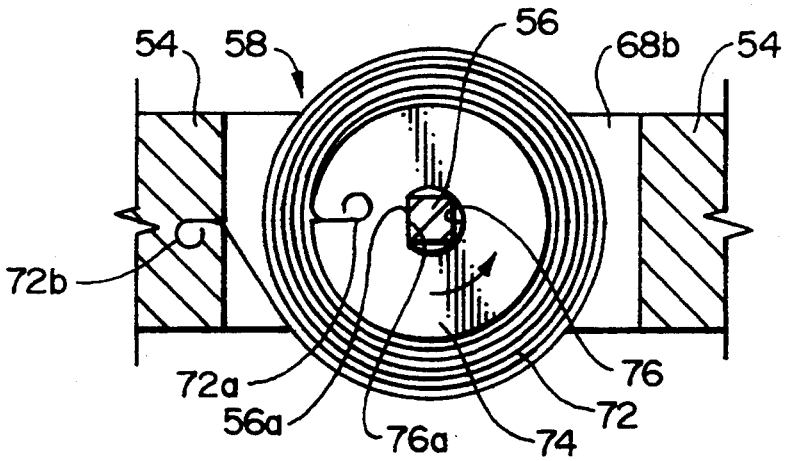
FIG. 9 is taken along lines 9—9 in FIG. 3.

The portions 68*a* and 68*c* of the orifice 68 are minimally sized and dimensioned to allow the shaft 56 to move relative to the housing 54 along the axis A and also rotate about the axis A relative to the housing 54. Referring for a moment to FIG. 9, it can be seen that the torsion spring portion 68*b* of the orifice 68 is enlarged to accommodate the torsion spring assembly 58. Referring again to FIG. 3, the orifice 68 is enlarged at the compression spring portion 68*d* to allow the compression spring 60 to be placed within the orifice 68 around the shaft 56. As shown in FIG. 3B, for reasons which will become clear from the following discussion, the hex portion 68*e* of the orifice 68 forms a female hex socket that matingly receives a hex portion 70 of the shaft 56.

Referring back to FIG. 9, it can be seen that the torsion spring assembly 58 comprises a torsion spring 72 and a collar 74. A first end 72*a* of the spring 72 is attached to the collar 74 and a second end 72*b* of the spring is attached to the housing 54. A shaft hole 76 is formed in the collar 74. The shaft 56 passes through the shaft hole 76. The shaft 56 has at least one flattened surface 56*a* which so engages a similar surface 76*a* of the shaft hole 76 that rotation of one of the collar 74 and the shaft 56 about the axis A (perpendicular to the page in FIG. 9) is transmitted to the other of the collar 74 and the shaft 56; at the same time, the hole 76 is sized and dimensioned to allow movement of the shaft 56 along the axis A relative to the collar 74.

As briefly mentioned above, the compression spring 60 is mounted within the orifice 68 around the shaft 56. The spring 60 is attached at one end to the housing 54. The other end of the spring 60 abuts the hex portion 70 of the shaft 56. When the orifice hex portion 68*e* receives the shaft hex portion 70, the spring 60 is compressed.

The ball engaging member 62 has projections 62*a* which engage the ball 24 in a manner that imparts axial rotation of the shaft 56 about the axis A to the ball 24. When the ball is in contact with the engaging member 62 as shown in FIG. 3, the longitudinal axis of the ball is aligned with the axis A. Thus, if no other force is exerted on the ball 24, axial rotation of the shaft 56 causes the ball 24 to rotate about its longitudinal axis.

Referring again to the shaft 56, this shaft 56 has a reduced diameter locking groove 76 formed about its periphery. As shown in FIG. 3A, the locking fork 64 has a pair of tines 64*a* and 64*b* which straddle the shaft 56 at the locking groove 76. The locking fork 64 thus engages the walls of the groove 76 and prevents the shaft 56 from being displaced along the axis A by the force of the compression spring 60. Additionally, a stop washer 78 is placed on the shaft 56 to limit the amount of forward movement of the shaft 56 relative to the housing 54.

The locking mechanism 38 will now be discussed in detail. This mechanism 38 comprises a release lever 80, a locking pin 82, and a locking spring 84. The locking pin 82 is mounted to the structural frame 30 by brackets 86*a* and 86*b* in a manner that allows the pin 82 to move up and down. The spring 84 is placed around the pin 82 between a projection 82*a* on the pin 82 and the lower bracket 86*b*. Downward motion of the pin 82 thus compresses the spring 84.

A lower end 82*a* of the locking pin 82 is connected to the release lever 80. The release lever 82 is so rotatably attached to the structural frame 30 at a pivot point 90 that pulling a handle portion 80*a* of the lever 80 backwards displaces the locking pin 82 downwardly against the bias of the spring 84 into an unlocked position. When no force is applied to the handle 80*a*, the spring bias maintains the pin 82 in an upper, locked position.

When the locking pin 82 is in its upper, locked position, an upper end 82*b* thereof extends through holes 66*a*, 66*b*, or 66*c* in the locking flange 66. The locking pin 82 prevents forward motion of the ball carriage 34 when the pin 82 extends through these holes 66*a*, 66*b*, and 66*c*. Rotating the lever 80 so that the pin 82 is in the lower, unlocked position releases the ball carriage 34, allowing the carriage 34 to move forward. A slanted surface 82*c* on the pin upper end 82*b* allows rearward motion of the locking flange 66 to cause the pin 82 to move downwardly against the bias of the spring 84.

It should be clear to one of ordinary skill in the art that the structural frame can be constructed in a number of ways. As shown in FIG. 2, the exemplary frame 30 comprises the rails 32, a back plate 92, a front plate 94, a middle plate 96, and a shoulder rest 98. The rails 32 extend between the back and front plates 92 and 94, and the shoulder rest 98 is rigidly mounted to the back plate 92 and the middle plate 96. The exemplary rails 32 are tubular.

Additionally, stop sleeves 100 are mounted on the rails 32, and release members 102 having release surfaces 104 are mounted on the front plate 94. Release rollers 106 are mounted on the release members 102 immediately rear of the release surfaces 104. One release member 102 is provided for each gripping arm 44, and the release members 102 are mounted forward of the gripping arms 44 for reasons which will be explained in detail below.

Figure 6:
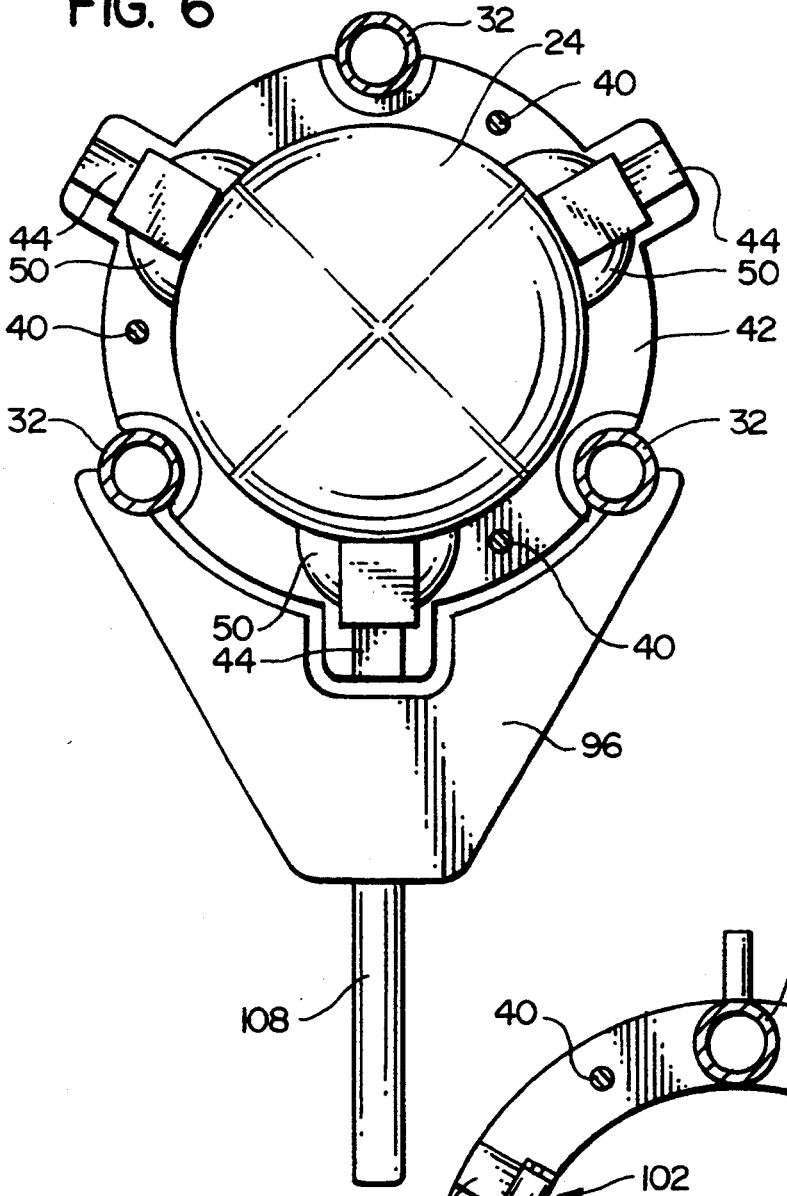
FIG. 6 is taken along lines 6—6 in FIG. 2.
Figure 7:
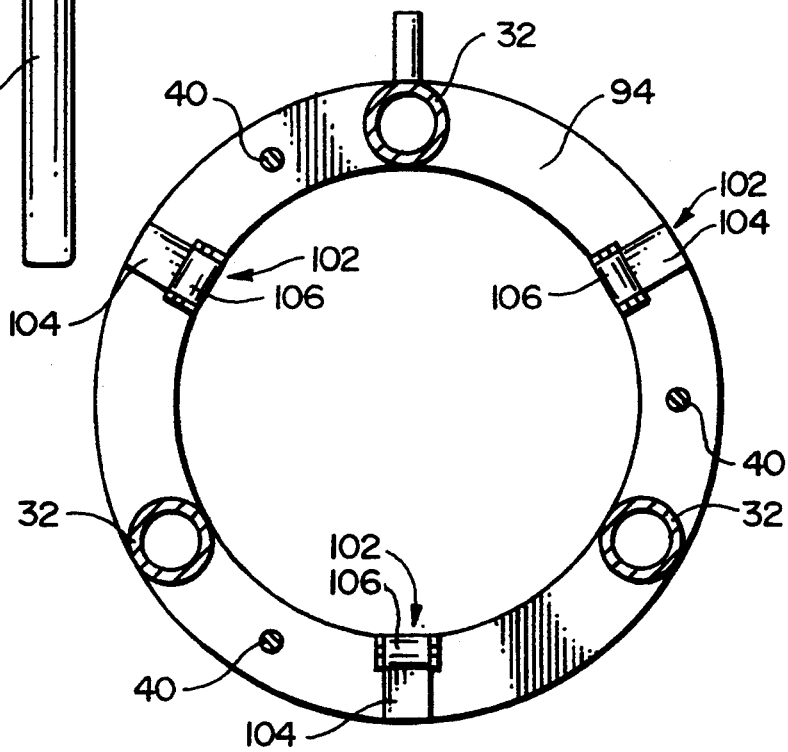
FIG. 7 is taken along lines 7—7 in FIG. 2.

As is perhaps best shown in FIGS. 6 and 7, the rails 32 are spaced 120° from each other, the resilient members 40 are spaced 120° from each other, and the release members 102 are spaced are spaced 120° from each other. It should also be noted that the rails 32, gripping arms 44, and release members 102 are symmetrically arranged about a vertical plane extending through the axis A. This provides a relatively balanced and lightweight arrangement.

Additionally, it should be clear that by providing a slot in each of the tubular rails 32, the carriage plate 42 could be made to project into the rails through these slots so that the resilient members 40 could be mounted within the rails 32.

While three such resilient members are employed in the exemplary apparatus 20, more such members may be employed to achieve a desired velocity of the football 24 as it leaves the apparatus 20.

The structural frame 30 also comprises a support stake 108 extending downwardly from the middle plate 96. This support stake 108 allows the stand 22 to engage the structural frame 30 and thus support the apparatus 20.

An adjustable sighting system 110 is also mounted on the structural frame 30. As is perhaps best shown in FIG. 2, this sighting system 110 comprises a sighting rod 112 and a sighting projection 114. The sighting projection is mounted on the front plate 94, and the sighting rod is mounted on the rear plate 92. The sighting rod 112 has marks 116 formed thereon and is vertically adjustable to allow calibration of the sighting system 110.

The football throwing apparatus 20 operates in the following manner. Initially, the shaft 56 is rotated a given number of turns against the bias of the torsion spring 58. The direction and number of turns corresponds to the direction and amount of axial spin imparted to the ball 24.

The shaft 56 is then pulled against the bias of the compression spring 60 until the male hex portion 70 of the shaft 56 engages the female hex portion 68*e* of the orifice 68 in the housing 54.

The locking fork 64 may then be placed so that the tines 64*a* and 64*b* engage the groove 76 in the shaft 56. This keeps the compression spring 60 from forcing the hex portion 70 of the shaft 56 out of the hex portion 68*e* of the orifice 68. The orifice hex portion 68*e* engages the shaft hex portion 70 to prevent the torsion spring 58 from rotating the shaft 56.

Next, the football 24 is placed between the gripping arms 44 and engages the ball engaging member 62. At this point, the tensioning members 46 pull the gripping arms 44 radially inwardly, causing the gripping members 50 to engage and grip the football 24. The gripping arms 44 thus act against the bias of the compression spring 60 through the football 24 and the engaging member 62. The locking fork 64 may therefore be removed when the football 24 is gripped by the arms 44.

The entire ball carriage 34 is next pulled back against the force of the resilient members 40 until the locking flange 66 contacts the locking pin 82. The flange 66 engages the slanted surface 82*c* on the pin 82 and depresses the pin 82 against the force of the locking spring 84. The ball carriage 34 may be pulled back further until the pin 82 is forced up by the locking spring 84 into an appropriate one of the holes 66*a*, 66*b*, or 66*c* in the locking flange 66. The farther back the carriage 34 is drawn, the higher the velocity of the ball 24 as it leaves the apparatus 20.

Once the ball 24 is loaded into the apparatus 20, the apparatus 20 is aimed using the sighting system 110. Specifically, the operator 26 aligns a given mark 116 on the sighting rod 112, the tip of the sighting projection 114, and a spot 118 (FIG. 1) where the operator desires the ball 24 to be thrown. Each mark 116 on the rod 112 corresponds to the distance the ball will be projected.

Figure 4:
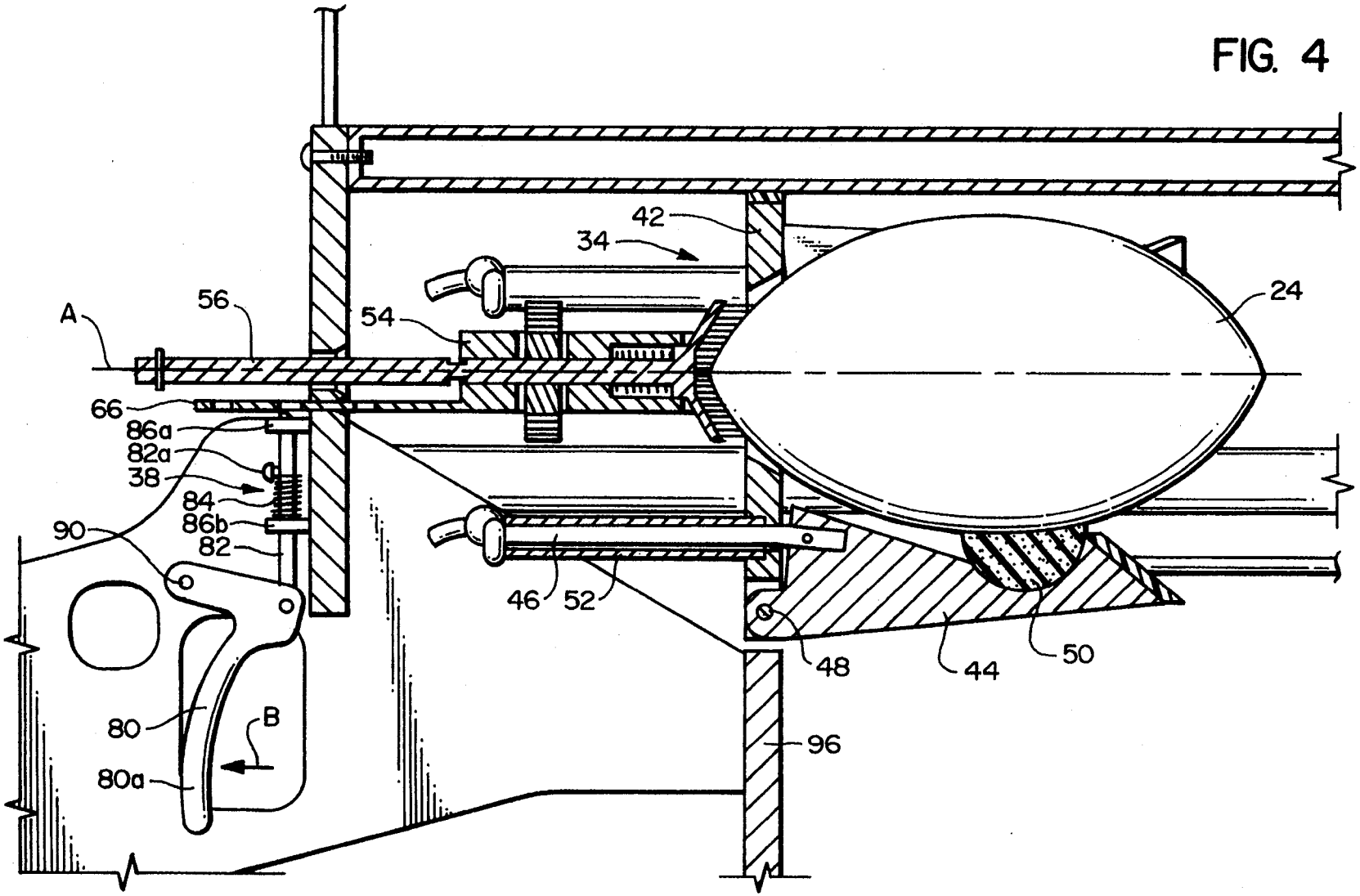
FIG. 4 is a side, cut-away view of a section of the apparatus depicted in FIG. 1 illustrating the apparatus when it is loaded.

Once the apparatus 20 is correctly aimed, the handle portion 80*a* of the release lever 80 is pulled back as shown by the arrow B in FIG. 4, drawing the locking pin 82 down against the bias of the locking spring 84. The ball carriage 34 is thus free to move forward.

Figure 5:
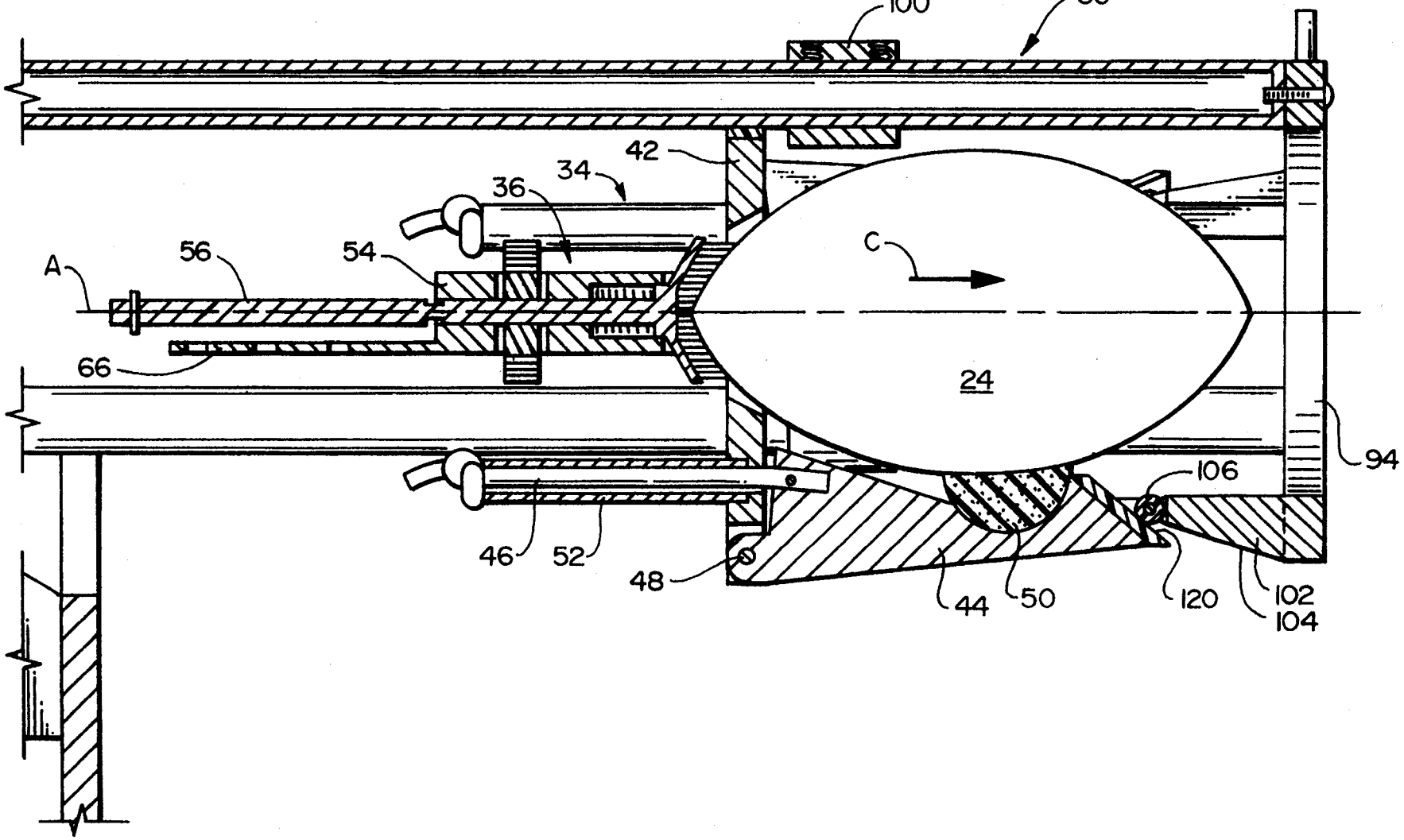
FIG. 5 is a side, cut-away view of a section of the apparatus depicted in FIG. 1 illustrating the apparatus immediately prior to release of the football.

The resilient members 40 then force the ball carriage 34 forward as indicated by arrow C in FIG. 5. The ball carriage 34 eventually reaches the end of the structural frame 30 when slanted surfaces 120 on the gripping arms 44 contact the release rollers 106. The release rollers 106 spread the gripping arms 44 apart against the force applied to these arms 44 by the tensioning members 46.

Figure 8:
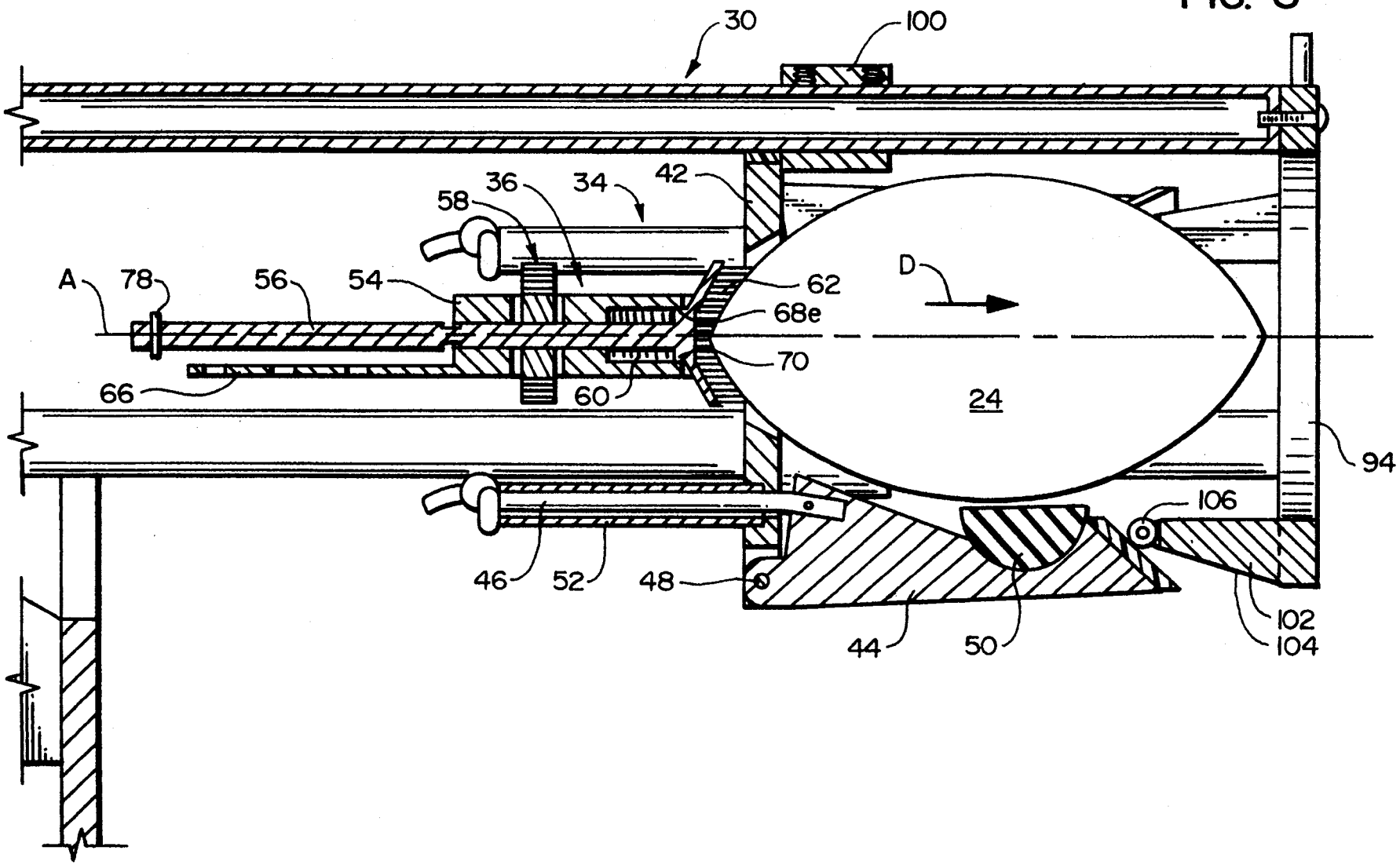
FIG. 8 is a side, cut-away view of a section of the apparatus depicted in FIG. 1 illustrating the apparatus immediately after the release of the football.

Therefore, as shown in FIG. 8, the ball 24 is no longer gripped by the Gripping arms 44 after the rollers 106 spread the arms 44 apart. At this point, the carriage plate 42 contacts the stop sleeves 100, stopping the forward motion of the ball carriage 34 relative to the frame 30. However, because the ball 24 is no longer held in place by the gripping arms 44, the ball 24 continues to move forward as shown by the arrow D in FIG. 8.

The fact that the gripping arms 44 no longer holde the ball 24 in place relative to the carriage 34 allows the compression spring 60 to force the shaft 56 forward relative to the housing 54. The ball engaging member 62 thus remains engaged with the ball 24 as the ball moves relative to the carriage 34.

Figure 10:
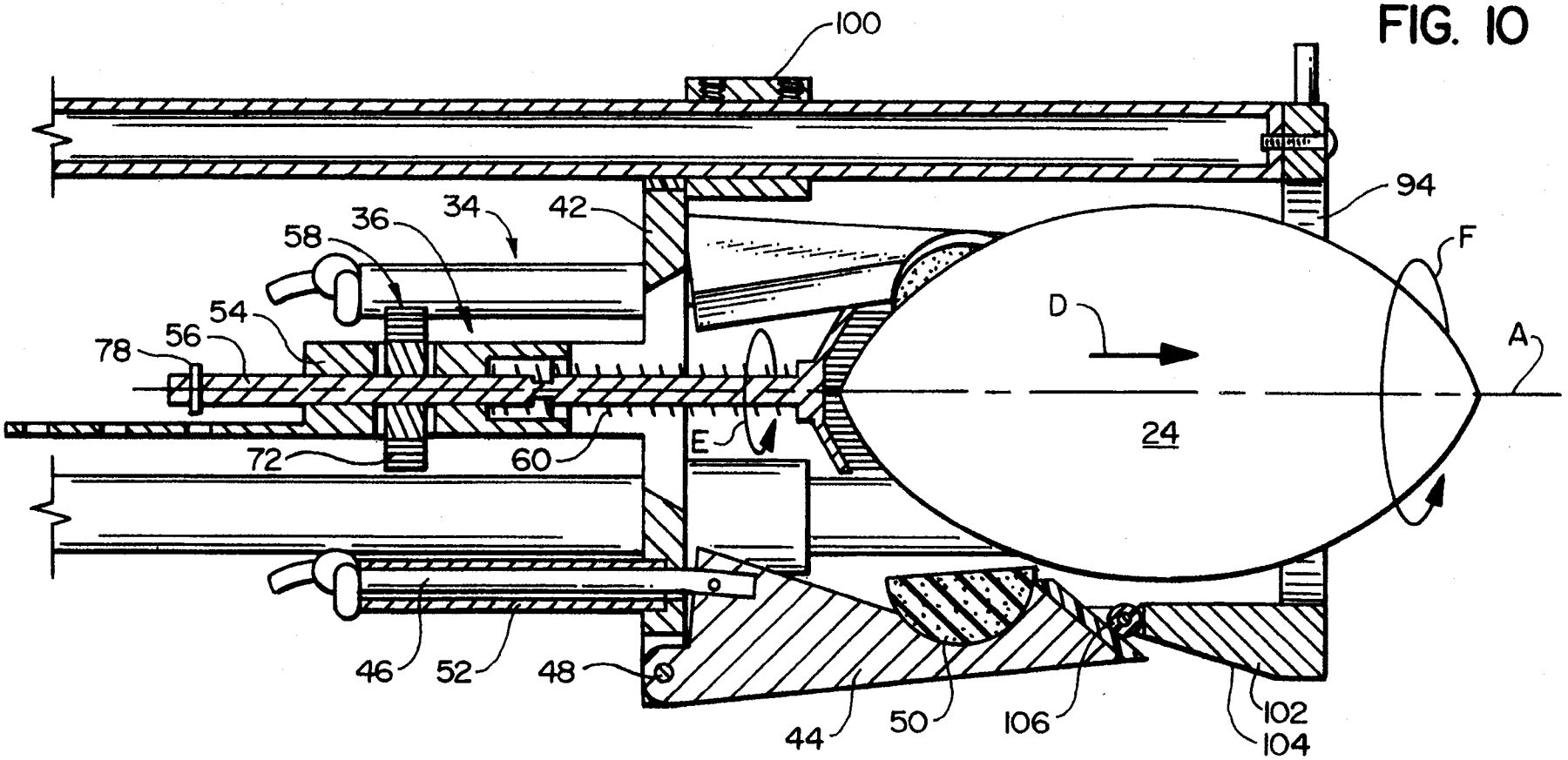
FIG. 10 is a side, cut-away view of a section of the apparatus depicted in FIG. 1 illustrating the apparatus as the ball rotating means rotates the football.

At the same time, the hex portion 70 of the shaft 56 leaves the hex portion 68*e* of the orifice 68 in the housing 54. As shown in FIG. 10, the torsion spring 72 is thus free to unwind, thereby rotating the shaft 56 about its longitudinal axis. The shaft 56 thus is thus displaced along the longitudinal axis A by the compression spring 60 and is axially rotated about the axis A by the torsion spring 72.

The forward motion of the shaft 56 maintains the engaging member 60 in contact with the ball 24 as the ball 24 leaves the apparatus 20; since the shaft 56 is axially rotating as just described, this axial rotation (arrow E in FIG. 10) is imparted to the ball 24, causing the ball to rotate about its axis, or spiral, in the direction of the arrow F in FIG. 10.

The stop washer 78 eventually contacts the housing 54 to prevent further forward motion of the shaft 56 relative to the housing 54. The ball 24 then proceeds along its trajectory to the desired spot 118 where it is to be caught.

It should be clear that the velocity of the ball is determined by the strength of the resilient members 40. Thus, to simulate the throw of a specific individual, the resilient members 40 must be chosen so that their strength results in a ball velocity that is similar under a given set of circumstances to that of the specific individual. The use of appropriate holes 66*a*, 66*b*, and 66*c* in the locking flange 66 allows variation of throwing strength for a given set of resilient members 40.

Also, the axial rotation of the ball 24 is determined by the direction and amount of rotation of the torsional spring 72. The more tightly this spring 72 is wound, the higher the speed of rotation of the ball 24. The spring may also be reversed to simulate the spin imparted to the football by either a right handed thrower or a left handed thrower.

The sighting system 110 may be calibrated in the following manner. The velocity and amount and direction of spin applied to the football by a specific individual are first determined. The strength of the resilient members and the orientation and tightness of the torsion spring are then chosen to emulate the flight characteristics of a football thrown by that specific individual. The apparatus 20 is employed to throw footballs to a spot a known distance away on the field. The sighting rod 112 is then adjusted up or down so that a marking 116 thereon indicating the known distance is aligned with the sighting projection and the spot where the ball lands.

In the above described exemplary embodiment, the shaft 56 is prevented from moving forward relative to the housing 54 by the action of the gripping arms 44 on the football 24. When the gripping arms 44 release the football 24, the shaft 56 is free to move forward relative to the housing 54.

Figure 11:
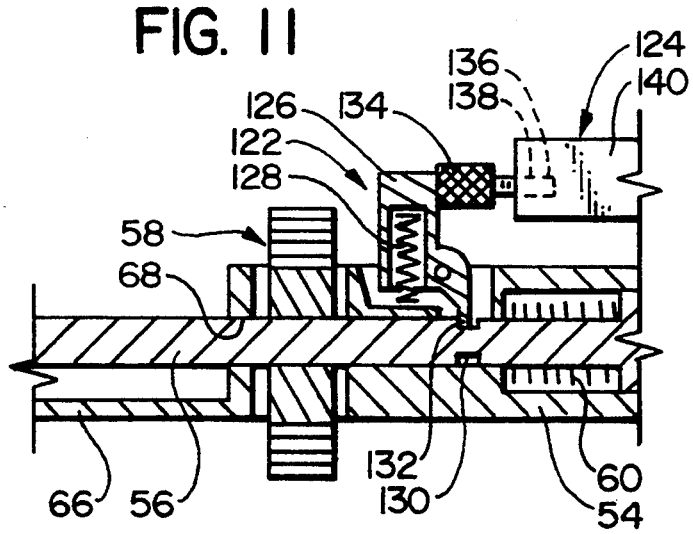
FIG. 11 is a side, cut-away view of a section of a portion of an apparatus such as that depicted in FIG. 1 incorporating an optional triggering device, the triggering device being shown immediately prior to release of the football.
Figure 12:
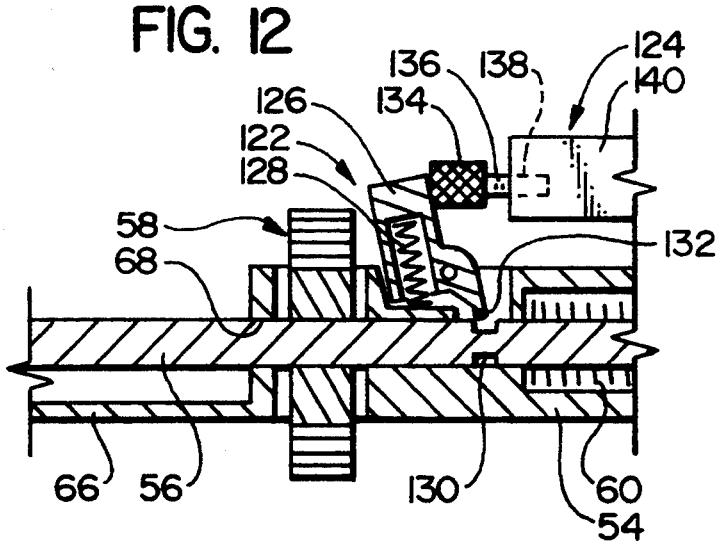
FIG. 12 is a side, cut-away view of the triggering device depicted in FIG. 11 shown during release of the football.

Alternatively, a triggering mechanism 122 as shown in FIGS. 11 and 12 may be provided for releasing the shaft 56. This triggering mechanism 122 basically comprises a stop projection 124 fixedly mounted on the frame, a lever 126 rotatably attached to the housing 54, a spring 128, and a depression 130 formed on the shaft 56. As shown in FIG. 11, before the football 24 is ejected from the apparatus 20, the spring 128 so acts on the lever 126 that lever is in a loaded position in which a shaft engaging projection 132 on the lever extends into the depression 130 to prevent forward movement of the shaft 56 relative to the housing 54.

At the point of ejection (FIG. 12), forward motion of the housing 54 causes the lever 126 to engage the stop projection 124 and so rotate against the force applied by the spring 128 that the projection 132 leaves the groove 130, thereby allowing the shaft 56 to move forward relative to the housing 54.

To adjust the triggering device 122 so that the shaft 56 is released at the proper time, the stop projection 124 comprises a knurled knob 134 having a threaded portion 136 matingly received in a threaded hole 138 in a member 140 connected to the frame 30. Axial rotation of the knob 134 displaces this knob 134 relative to the member 140. This allows the timing of the contact between the lever 126 and the knob 134 to be adjusted as necessary to ensure the shaft 56 is released at the appropriate time.

It should be clear that the present invention may be embodied in forms other than that described above. The above-described example is therefore to be considered in all respects illustrative and not restrictive, the scope of the invention being indicated by the appended claims rather than the foregoing description. All changes that come within the meaning and scope of the claims are intended to be embraced therein.

What is claimed is:

1. An apparatus for propelling footballs, comprising:

a. a structural frame having elongate bearing surfaces and a forward end from which the footballs are ejected;

b. carriage means adapted to contain the football, the carriage means being slidingly mounted on the bearing surfaces c. propulsion means for so urging the carriage means along the bearing surfaces towards the forward end that the football is propelled from the carriage means at the forward end of the frame;

d. ball rotating means mounted on the carriage means for applying rotation to the football as the football is propelled from the apparatus in which the ball rotating means comprises, i. a shaft mounted on the carriage means and having rear and forward ends, ii. a football engaging member mounted on the forward end of the shaft, iii. first means for axially rotating the shaft, and iv. second means for displacing the shaft along its axis toward the forward end of the structural frame, wherein the football engaging member so engages the football that axial rotation of the shaft is imparted to the football; and e. gripping means for preventing movement of the shaft relative to the carriage means until after the football is propelled from the carriage means.

2. An apparatus as recited in claim 1, in which the gripping means comprises:

a. a plurality of gripping arms rotatably attached to the carriage member; and b. tensioning means associated with each gripping arm for so forcing the gripping arms together that the football is gripped therebetween; wherein when the carriage reaches the forward end, the gripping arms so contact the structural frame that the gripping arms are rotated against the force applied by the tensioning means to release the football.

3. An apparatus as recited in claim 1, in which the ball rotating means comprises a housing mounted on the carriage means, the shaft being mounted within the housing to allow axial rotation of the shaft and displacement of the shaft along its axis.

4. An apparatus as recited in claim 1, in which the propulsion means comprises at least one resilient member so connected between the carriage member and the structural frame that movement of the carriage member away from the front end of the frame causes the resilient member to stretch.

5. An apparatus as recited in claim 1, in which the apparatus has front and rear sighting members and a shoulder stock to improve the accuracy of the apparatus.

6. An apparatus as recited in claim 1, in which the rear sighting member is adjustable to allow the apparatus to be calibrated to match the throwing characteristics of a specific individual.

7. An apparatus as recited in claim 1, in which a plurality of elastic members may be added as necessary to increase the velocity of the football as it leaves the apparatus to a desired velocity.

8. An apparatus for throwing a football having a football axis, comprising:

a. a structural frame having a plurality of rails, a rear end, a forward end from which the footballs are ejected, and a frame axis;

b. carriage means for so containing the football that the football axis is aligned with the frame axis, the carriage means being so slidingly mounted on the rails that the carriage means moves along the frame axis;

c. at least one resilient member so connected between the structural frame and the carriage means that, when deformed, the resilient member urges the carriage member towards the frame forward end to propel the football out of the carriage means;

d. ball rotating means mounted on the carriage means for applying rotation to the football as the football is propelled from the apparatus; and e. locking means for releasably locking the carriage means in a locked position adjacent the frame rear end, the resilient member being deformed when the carriage means is in the locked position.

9. An apparatus as recited in claim 8, in which the ball rotating means comprises:

a. a shaft mounted on the carriage means and having rear and forward ends;

b. a football engaging member mounted on the forward end of the shaft;

c. first means for axially rotating the shaft; and d. second means for displacing the shaft along its axis toward the forward end of the structural frame; wherein the football engaging member so engages the football that axial rotation of the shaft causes the football to rotate about its axis.

10. An apparatus as recited in claim 9, in which the gripping means comprises:

a. a plurality of gripping arms rotatably attached to the carriage member; and b. tensioning means associated with each gripping arm for so forcing the gripping arms together that the football is gripped therebetween; wherein when the carriage reaches the forward end, the gripping arms so contact the structural frame that the gripping arms are rotated against the force applied by the tensioning means to release the football.

11. An apparatus as recited in claim 10, in which the ball rotating means comprises a housing mounted on the carriage means, the shaft being mounted within the housing to allow axial rotation of the shaft and displacement of the shaft along its axis.

12. An apparatus as recited in claim 11, in which the first means comprises:

a. a torsion spring attached at a first end to the housing; and b. means for so coupling a second end of the torsion spring to the shaft that rotation of the second end about the shaft axis is imparted to the shaft and the shaft may be displaced along its axis relative to the torsion spring.

13. An apparatus as recited in claim 12, in which the second means comprises a compression spring having a first end in contact with the housing and a second end in contact with the shaft, where, when the compression spring is compressed, it applies a force on the shaft Which tends to displace the shaft relative to the housing in the direction of the forward end.

14. An apparatus for propelling footballs, comprising:

a. a structural frame having elongate bearing surfaces and a forward end from which the footballs are ejected;

b. carriage means adapted to contain the football, the carriage means being slidably mounted on the bearing surfaces;

c. propulsion means for so urging the carriage means along the bearing surfaces towards the forward end that the football is propelled from the carriage means at the forward end of the frame; and d. ball rotating means mounted on the carriage means for applying rotation to the football as the football is propelled from the apparatus; wherein the ball rotating means comprises:

i. a shaft mounted on the carriage means and having rear and forward ends;

ii. a football engaging member mounted on the forward end of the shaft;

iii. first means for axially rotating the shaft;

iv. second means for displacing the shaft along its axis toward the forward end of the structural frame;

v. a housing mounted on the carriage means, the shaft being mounted within the housing to allow axial rotation of the shaft and displacement of the shaft along its axis, wherein the football engaging member so engages the football that axial rotation of the shaft is imparted to the football.

15. An apparatus as recited in claim 14, in which the first means comprises;

a. a torsion spring attached at a first end to the housing; and b. means for so coupling a second end of the torsion spring to the shaft that rotation of the second end about the shaft axis is imparted to the shaft and the shaft may be displaced along its axis relative to the torsion spring.

16. An apparatus as recited in claim 14, in which the second means comprises a compression spring having a first end in contact with the housing and a second end in contact with the shaft, where, when the compression spring is compressed, it applies a force on the shaft which tends to displace the shaft relative to the housing in the direction of the forward end.

17. An apparatus as recited in claim 14, further comprising a trigger means for releasably locking the shaft relative to the housing, the trigger means releasing when the carriage arrives at a predetermined point on the structural frame.

18. An apparatus for propelling footballs, comprising:

a. a structural frame having elongate bearing surfaces and a forward end from which the footballs are ejected;

b. carriage means adapted to contain the football, the carriage means being slidingly mounted on the bearing surfaces c. propulsion means for so urging the carriage means along the bearing surfaces towards the forward end that the football is propelled from the carriage means at the forward end of the frame;

d. ball rotating means mounted on the carriage means for applying rotation to the football as the football is propelled from the apparatus; wherein the carriage means comprises means for releasably gripping the football, the gripping means releasing the football at the forward end upon reaching the forward end of the structural frame; and the structural frame comprises at least one release member, where the at least one release member is so formed on the structural frame that the release member contacts the gripping means and causes the gripping means to release the football when the carriage member reaches the forward end of the frame.

19. An apparatus for propelling footballs, comprising:

a. a structural frame having elongate bearing surfaces and a forward end from which the footballs are ejected;

b. carriage means adapted to contain the football, the carriage means being slidingly mounted on the bearing surfaces c. propulsion means for so urging the carriage means along the bearing surfaces towards the forward end that the football is propelled from the carriage means at the forward end of the frame;

d. ball rotating means mounted on the carriage means for applying rotation to the football as the football is propelled from the apparatus; wherein the carriage means comprises means for releasably gripping the football, the gripping means releasing the football at the forward end upon reaching the forward end of the structural frame; and the gripping means comprises (i) a plurality of gripping arms rotatably attached to the carriage member and (ii) tensioning means associated with each gripping arm for so forcing the gripping arms together that the football is gripped therebetween, where, when the carriage reaches the forward end, the gripping arms so contact the structural frame that the gripping arms are rotated against the force applied by the tensioning means to release the football.

20. An apparatus for propelling footballs, comprising:

a. a structural frame having elongate bearing surfaces and a forward end from which the footballs are ejected;

b. carriage means adapted to contain the football, the carriage means being slidingly mounted on the bearing surfaces c. propulsion means for so urging the carriage means along the bearing surfaces towards the forward end that the football is propelled from the carriage means at the forward end of the frame;

d. ball rotating means mounted on the carriage means for applying rotation to the football as the football is propelled from the apparatus; and e. locking means for releasably locking the carriage means relative to the structural frame in a locked position against the urging of the propulsion means.

21. An apparatus as recited in claim 20, in which the locking means comprises:

a. a locking pin so mounted on the structural frame that the pin may move along its axis;

b. spring means for so forcing the pin in a first direction along its axis into engagement with the carriage means that the locking pin prevents relative movement of the carriage means relative to the structural frame; and c. means for so displacing the locking pin along its axis against the force of the spring means that the locking pin no longer engages the carriage means, thereby allowing the carriage means to move relative to the structural frame.

22. An apparatus as recited in claim 21, in which the carriage means comprises a member having at least one hole formed therein through which the locking pin extends to engage the carriage means.

23. An apparatus for propelling footballs, comprising:

a. a structural frame having elongate bearing surfaces and a forward end from which the footballs are ejected;

b. carriage means adapted to contain the football, the carriage means being slidingly mounted on the bearing surfaces c. propulsion means for so urging the carriage means along the bearing surfaces towards the forward end that the football is propelled from the carriage means at the forward end of the frame;

d. ball rotating means mounted on the carriage means for applying rotation to the football as the football is propelled from the apparatus; wherein the propulsion means comprises at least one resilient member so connected between the carriage member and the structural frame that movement of the carriage member away from the front end of the frame causes the resilient member to stretch.

* * * * *